US006799733B1

(12) United States Patent
Pace et al.

(10) Patent No.: US 6,799,733 B1
(45) Date of Patent: Oct. 5, 2004

(54) FUEL INJECTOR HAVING A MODIFIED SEAT FOR ENHANCED COMPRESSED NATURAL GAS JET MIXING

(75) Inventors: Jeff Pace, Newport News, VA (US); Vernon Richard Warner, Wicomico, VA (US); Daniel Scott Baker, Sr., Hampton, VA (US); James H. Cohen, Virginia Beach, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/605,654

(22) Filed: Jun. 28, 2000

(51) Int. Cl.[7] ..... F02M 61/00

(52) U.S. Cl. ..... 239/533.12; 236/533.3; 236/585.1; 236/585.5

(58) Field of Search ..... 239/533.3, 533.12, 239/585.1, 585.4, 585.5, 900

(56) References Cited

U.S. PATENT DOCUMENTS

| | | | | |
|---|---|---|---|---|
| 2,291,968 A | | 8/1942 | Keefe | |
| 3,662,987 A | | 5/1972 | Schlagmuller et al. | 251/139 |
| 4,570,598 A | * | 2/1986 | Samson et al. | 239/585.1 |
| 4,650,122 A | * | 3/1987 | Kienzle et al. | 239/585.1 |
| 4,662,567 A | | 5/1987 | Knapp | 239/585 |
| 4,783,009 A | | 11/1988 | Coates | 239/580 |
| 4,830,286 A | * | 5/1989 | Asslaender et al. | 239/585.1 |
| 4,909,447 A | | 3/1990 | Gallup et al. | 239/585 |
| 4,946,107 A | | 8/1990 | Hunt | 239/585 |
| 4,978,074 A | | 12/1990 | Weinand | 239/585 |
| 4,988,967 A | | 1/1991 | Miller et al. | 335/279 |
| 5,035,360 A | | 7/1991 | Green et al. | 239/585 |
| 5,046,472 A | | 9/1991 | Linder | 123/533 |
| 5,127,585 A | | 7/1992 | Mesenich | 239/585.5 |
| 5,209,408 A | * | 5/1993 | Reiter | 239/585.4 |
| 5,341,994 A | | 8/1994 | Wakeman | 239/585.5 |
| 5,381,966 A | | 1/1995 | Gernert, II | 239/585.3 |
| 5,494,223 A | | 2/1996 | Hall et al. | 239/585.5 |
| 5,494,224 A | | 2/1996 | Hall et al. | 239/585.5 |
| 5,540,200 A | * | 7/1996 | Naitoh et al. | 239/533.12 |
| 5,566,920 A | | 10/1996 | Romann et al. | 251/129.21 |
| 5,609,304 A | | 3/1997 | Sasao | 239/585.4 |
| 5,613,640 A | | 3/1997 | Furuya et al. | 239/585.5 |
| 5,632,467 A | | 5/1997 | Just et al. | 251/129.21 |
| 5,678,767 A | | 10/1997 | Rahbar | 239/533.2 |
| 5,704,553 A | | 1/1998 | Wieczorek et al. | 239/585.1 |
| 5,794,860 A | | 8/1998 | Neumann | 239/585.3 |
| 6,003,791 A | | 12/1999 | Reiter | 239/575 |
| 6,027,050 A | * | 2/2000 | Rembold et al. | 239/585.5 |

FOREIGN PATENT DOCUMENTS

WO WO97/49911 * 12/1997

* cited by examiner

*Primary Examiner*—Christopher Kim

(57) ABSTRACT

A fuel injector having a fuel inlet, a fuel outlet, and a fuel passageway extending from the fuel inlet to the fuel outlet along a longitudinal axis. The fuel injector includes a body, a needle slidingly disposed within the body and a seat disposed at the fuel outlet. The seat has a plurality of passages, each of the plurality of passages having a central axis having an angle of inclination relative to the longitudinal axis.

24 Claims, 4 Drawing Sheets

FUEL INJECTOR HAVING A MODIFIED SEAT FOR ENHANCED COMPRESSED NATURAL GAS JET MIXING

FIELD OF INVENTION

This invention relates to fuel injectors in general, and more particularly to a high-pressure direct injection fuel injector assembly which includes a modified seat for enhanced compressed natural gas jet mixing for maximizing fuel combustion.

BACKGROUND OF INVENTION

In the case of internal combustion engines having direct injection systems, fuel injectors are conventionally used to provide a precise amount of fuel needed for combustion. Compressed natural gas (hereinafter sometimes referred to as "CNG") is a common automotive fuel for commercial fleet vehicles and residential customers. In vehicles, the CNG is delivered to the engine in precise amounts through fuel injectors, hereinafter referred to as "CNG injectors", or simply "fuel injectors". Injectors of the type contemplated herein are described in commonly assigned U.S. Pat. No. 5,494,224, the disclosure of which is incorporated by reference herein. The fuel injector described above is required to deliver the precise amount of fuel per injection pulse and maintain this accuracy over the life of the injector. In order to optimize the combustion of fuel, certain strategies are required in the design of high-pressure fuel injectors. These strategies are keyed to the delivery of fuel into the intake manifold of the internal combustion engine in precise amounts and flow patterns. Conventional fuel injector designs have failed to optimize the combustion of fuel injected into the intake manifold of an internal combustion engine.

SUMMARY OF THE INVENTION

The present invention overcomes the disadvantages of conventional fuel injectors and provides a fuel injector which incorporates a needle with a novel seat design, which can provide various flow patterns and improved spray atomization for fuel for improved combustion.

The present invention provides a fuel injector having a fuel inlet, a fuel outlet, and a fuel passageway extending from the fuel inlet to the fuel outlet along a longitudinal axis. The fuel injector includes a body, a needle slidingly disposed within the body and a seat disposed at the fuel outlet. The seat has a plurality of passages, each of the plurality of passages having a central axis having an angle of inclination relative to the longitudinal axis.

The present invention also provides a spray pattern generated by a fuel injector having a fuel inlet, a fuel outlet, a fuel passageway extending from the fuel inlet to the fuel outlet along a longitudinal axis, a body, a needle slidingly disposed within the body, and a seat disposed at the fuel outlet. The seat has a plurality of passages, each of the plurality of passages having a central axis having an angle of inclination relative to the longitudinal axis. The spray pattern includes a fan shape and at least one plume adjacent the fan shape.

The present invention also provides a method of generating a spray pattern from a fuel injector in a direct injection application. The fuel injector has a body, a longitudinal axis, a needle slidingly disposed within the body, and a seat disposed at the fuel outlet. The method includes the steps of providing the seat with a plurality of passages, each of the plurality of passages having a central axis having an angle of inclination relative to the longitudinal axis, and supplying fuel to the fuel injector so that a spray pattern is formed.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
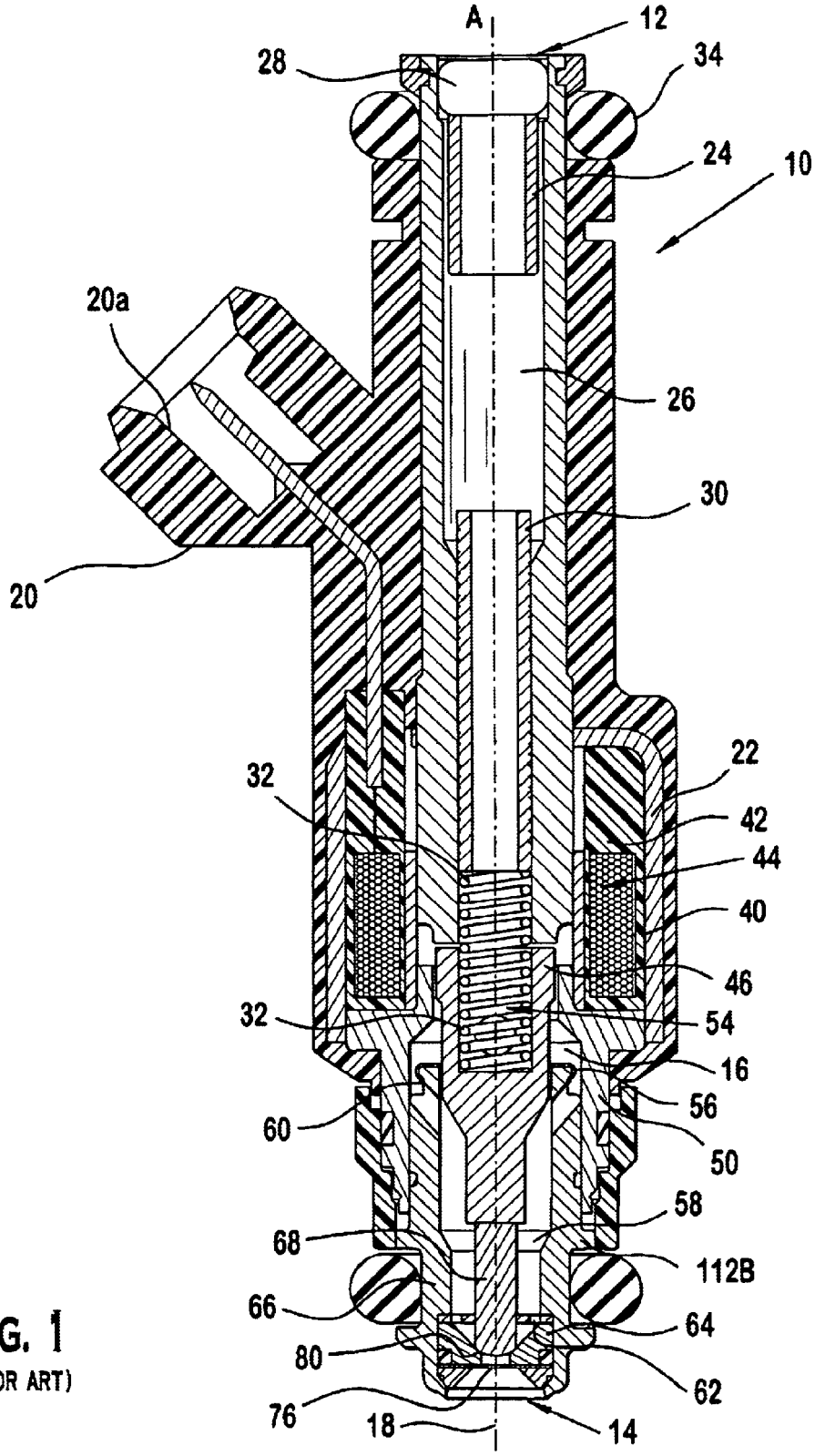
FIG. 1 (PRIOR ART)
FIG. 1 is a cross-sectional view of a conventional fuel injector taken along its longitudinal axis.

FIG. 1 illustrates a fuel injector assembly 10, in particular a high-pressure, direct-injection fuel injector assembly 10. Features of the fuel injector assembly 10 are also disclosed in commonly assigned, commonly filed (application Ser. No. 09/320,178) application entitled "Contaminant Tolerant Compressed Natural Gas Injector and Method of Directing Gaseous Fuel Therethrough," the disclosure of which is incorporated herein by reference. The fuel injector assembly 10 has a housing, which includes a fuel inlet 12, a fuel outlet 14, and a fuel passageway 16 extending from the fuel inlet 12 to the fuel outlet 14 along a longitudinal axis 18. The housing includes an overmolded plastic member 20 cincturing a metallic support member 22.

A fuel inlet member 24 with an inlet passage 26 is disposed within the overmolded plastic member 20. The inlet passage 26 serves as part of the fuel passageway 16 of the fuel injector assembly 10. A fuel filter 28 and an adjustable tube 30 is provided in the inlet passage 26. The adjustable tube 30 is positionable along the longitudinal axis 18 before being secured in place, thereby varying the length of an armature bias spring 32. In combination with other factors, the length of the spring 32, and hence the bias force against the armature, control the quantity of fuel flow through the fuel injector assembly 10. The overmolded plastic member 20 also supports a socket 20*a* that receives a plug (not shown) to operatively connect the fuel injector assembly 10 to an external source of electrical potential, such as an electronic control unit ECU (not shown). An elastomeric O-ring 34 is provided in a groove on an exterior extension of the inlet member 24. The 0ring 34 sealingly secures the inlet member 24 to a fuel supply member (not shown), such as a fuel rail.

The metallic support member 22 encloses a coil assembly 40. The coil assembly 40 includes a bobbin 42 that retains a coil 44. The ends of the coil assembly 40 are electrically connected to the socket 20*a* of the overmolded plastic member 20. An armature 46 is supported for relative movement along the axis 18 with respect to the inlet member 24. The armature 46 is supported by a body shell 50, and a body 52. The armature 46 has an armature passage 54 in fluid communication with the inlet passage 26.

The body shell 50 engages the body 52. An armature guide eyelet 56 is located on an inlet portion 60 of the body 52. An axially extending body passage 58 connects the inlet portion 60 of the body 52 with an outlet portion 62 of the body 52. The armature passage 54 of the armature 46 is in fluid communication with the body passage 58 of the body 52. A seat 64, which is preferably a metallic material, is mounted at the outlet portion 62 of the body 52.

The body 52 includes a neck portion 66 that extends between the inlet portion 60 and the outlet portion 62. The neck portion 66 can be an annulus that surrounds a needle 68. The needle 68 is operatively connected to the armature 46, and can be a substantially cylindrical needle 68. The cylindrical needle 68 is centrally located within and spaced from the neck portion so as to define a part of the body passage 58. The cylindrical needle 68 is axially aligned with the longitudinal axis 18 of the fuel injector assembly 10. Significant features of the needle herein are also disclosed in commonly assigned, commonly filed (application Ser. No. 09/320,176) application entitled "Compressed Needle Gas Injector Having Low Noise Valve Needle," the disclosure of which is incorporated herein by reference.

Operative performance of the fuel injector assembly 10 is achieved by magnetically coupling the armature 46 to the end of the inlet member 26 that is closest to the inlet portion 60 of the body 52. Thus, the lower portion of the inlet member 26 that is proximate to the armature 46 serves as part of the magnetic circuit formed with the armature 46 and coil assembly 40. The armature 46 is guided by the armature guide eyelet 56 and is responsive to an electromagnetic force generated by the coil assembly 40 for axially reciprocating the armature 46 along the longitudinal axis 18 of the fuel injector assembly 10. The electromagnetic force is generated by current flow from the ECU (not shown) through the coil assembly 40. Movement of the armature 46 also moves the operatively attached needle 68. The needle 68 engages the seat 64, which opens and closes the single conventional seat passage 76 of the seat 64 of the present invention to permit or inhibit, respectively, fuel from exiting the outlet of the fuel injector assembly 10. In order to open seat passage 76, the seal between the tip of needle 68 and the seat 64 is broken by upward movement of the needle 68. The needle 68 moves upwards when the magnetic force is substantially higher then it needs to bbe to lift the armature needle assembly against the force of spring 32. In order to close the seat passage 76 of the seat 64, the magnetic coil assembly 40 is de-energized. This allows the tip of needle 68 to re-engage surface 80 of seat 64 and close passage 76. During operation, fuel flows in fluid communication from the fuel inlet source (not shown) through the fuel inlet passage 26 of the inlet member 24, the armature passage 54 of the armature 46, the body passage 58 of the body 52, and the seat passage 76 of the seat 64 and is injected from the outlet 14 of the fuel injector assembly 10.

Significant features of the fuel injector assembly 10 in regards to the movement of needle 68 under the magnetic force are also disclosed in commonly assigned, commonly filed (application Ser. No. 09/320,179) application entitled "Compressed Natural Gas Fuel Injector having Magnetic Pole Face Flux Director," the disclosure of which is incorporated herein by reference. Additional features of the fuel injector assembly 10 are also disclosed in commonly assigned, commonly filed (application Ser. No. 09/320,177) application entitled "Compressed Natural Gas Injector having Gaseous Dampening for Armature Needle Assembly during Opening," the disclosure of which is incorporated herein by reference. Additional features of the fuel injector assembly 10 and a single seat passage 76 are also disclosed in commonly assigned, commonly filed (application Ser. No. 09/320,175) application entitled "Gaseous Injector with Columnated Jet Orifice Flow Directing Device," the disclosure of which is incorporated herein by reference.

Figure 3A:
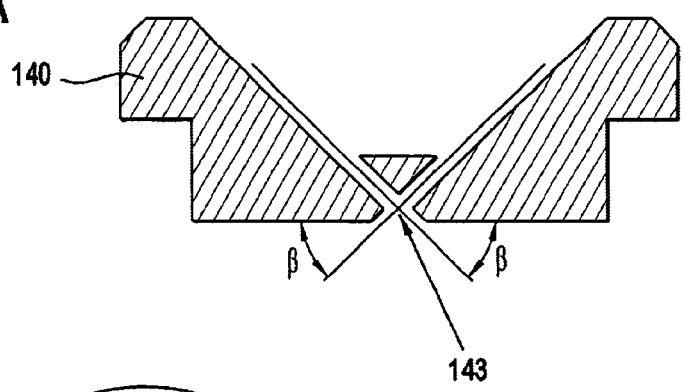
FIG. 3A is a front cross-sectional plan view of a modified outlet seat of a first preferred embodiment.
Figure 3B:
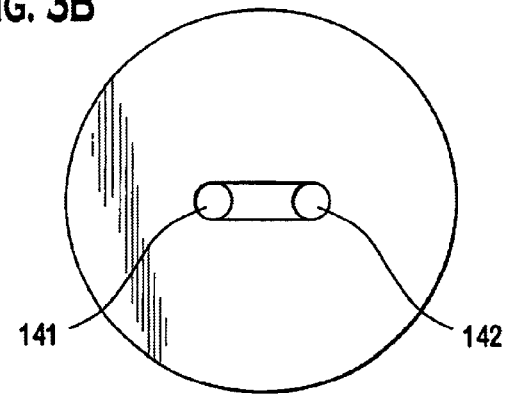
FIG. 3B is a top cross-sectional plan view of the modified outlet seat of the first preferred embodiment of FIG. 3A.
Figure 4:
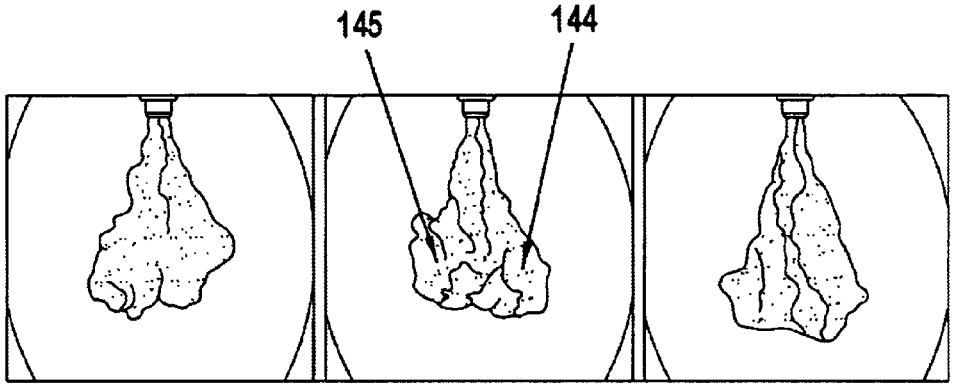
FIG. 4 is a front plan view of the CNG spray pattern for the modified outlet seat of the first preferred embodiment of FIG. 3A.
Figure 5:
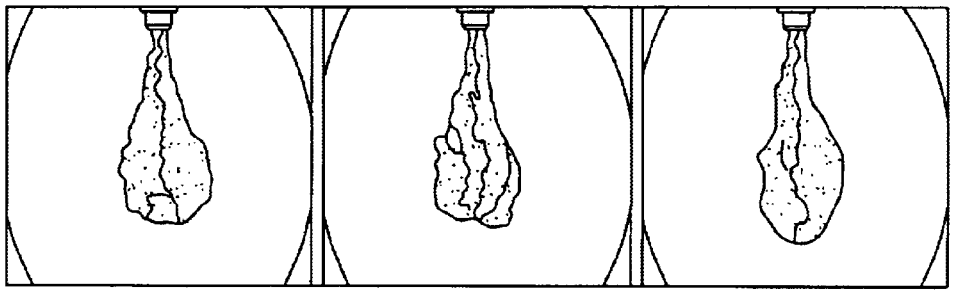
FIG. 5 is a side plan view of the CNG spray pattern for the modified outlet seat of the first preferred embodiment of FIG. 3A.

Next, the fuel spray pattern for a fuel injector with a modified seat design of the present invention will be described. A front cross-section plan view of the modified outlet seat 140 of a first preferred embodiment is shown in FIG. 3A. The modified seat 140 has a two inclined passages 141 and 142 which terminate into the exit passage 143. The spray pattern for the modified seat 140 of the first preferred embodiment is shown in FIGS. 4 and 5. The spray pattern image can be constructed by means of a Schlieren imaging system which uses a strobe light, imaging optics, and laser stand electronics, or by another means known in the art. For the CNG spray pattern of FIGS. 4 and 5, the test conditions were as follows; pressure=80 psig, laser delay=2.1 ms, and Helium was used as a working fluid for the Schlieren visualizations. FIGS. 4 and 5 show front and side plan views of the CNG spray pattern, respectively. It can be seen that the dual inclined seat passages 141 and 142 produce dual plumes 144 and 145, as shown in FIG. 4. The CNG spray emitted from the dual seat passages produces a "fan" shaped jet with dual plumes that allows for improved mixing and combustion. It should be noted that the seat passages 141 and 142 have the same cross-section and the same angle of inclination $\beta$ relative to the longitudinal axis 18.

Figure 2:
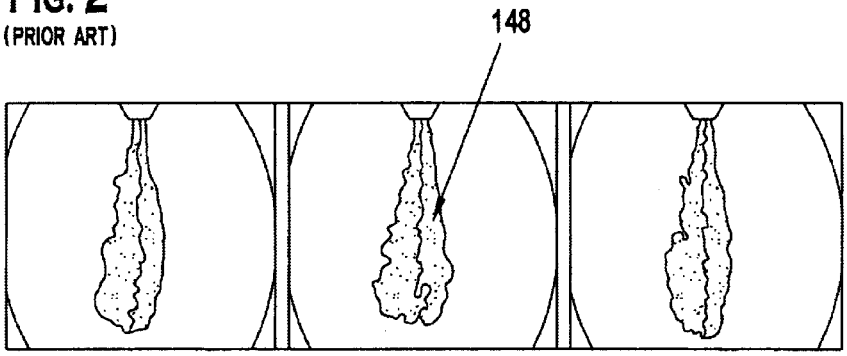
FIG. 2 (PRIOR ART)
FIG. 2 is a front plan view of the CNG spray pattern for the conventional fuel injector of FIG. 1.

As compared to the modified fuel injector design of the present invention, for the fuel injector shown in FIG. 1, the outlet seat 64 of the fuel injector assembly 10 has a single conventional seat passage 76 for fuel passage, as described earlier. As shown in FIG. 2, a plan view of the CNG spray pattern from the single seat passage 76 is illustrated. The CNG spray 45 pattern images of FIG. 2 were also constructed by means of the Schlieren imaging system, as described above. It can be seen that the CNG spray pattern using only a single seat passage 76 emits an axis-symmetric and well defined gas jet with a single plume 148. As compared to the "fan" shaped emission (dual plumes 144 and 145) of the modified fuel injector seat of FIG. 3A, the axis-symmetric emission (single plume 148) of the single conventional seat passage 76 of FIG. 1 results in poor mixing of the CNG spray and thus can result in poor combustion characteristics.

Figure 6:
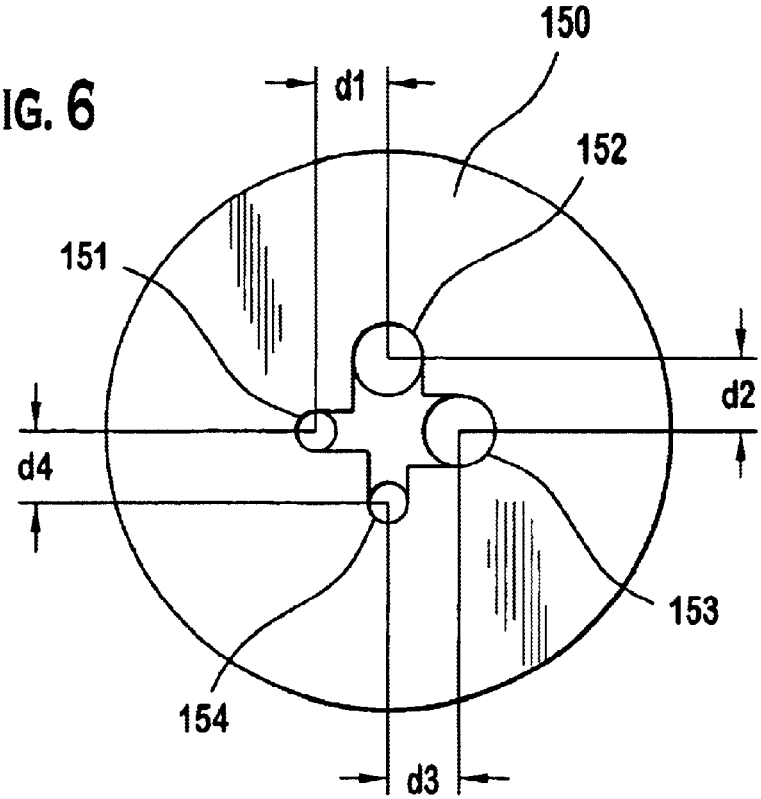
FIG. 6 is a top cross-sectional plan view of the modified outlet seat of a second preferred embodiment.
Figure 7:
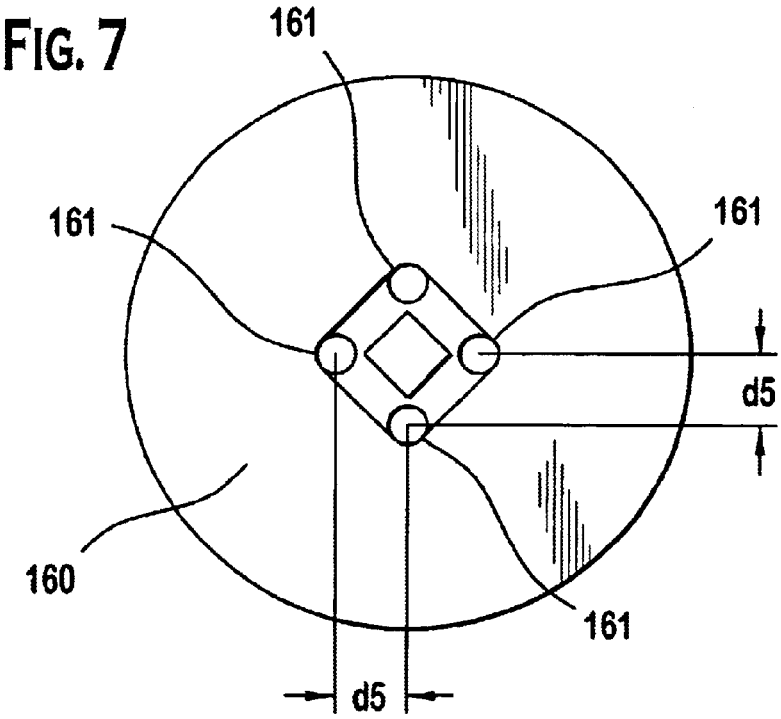
FIG. 7 is a top cross-sectional plan view of the modified outlet seat of a third preferred embodiment.

The concept of using a plurality of seat passages to produce an "fan" shaped jet can be extended to seat passages formed in various patterns and sizes. For example, as shown in FIGS. 6 and 7, top cross-sectional plan views of the modified outlet seats 150 and 160 of second and third preferred embodiments are illustrated, respectively. The outlet seat 150 has four seat passages 151, 152, 153 and 154 that each have a different cross-section. The passages 151, 152, 153 and 154 are also each at an inclination angle a (not shown) relative to the longitudinal axis 18, and at distances d1, d2, d3 and d4 from the central axis of the seat passage 150. Similarly, the outlet seat 160 has four inclined passages 161, each at an inclination angle $\gamma$ (not shown) relative to the longitudinal axis 18, and each at distance d5 from the central axis of the seat passage 160. It can be appreciated that the seat passage patterns for FIGS. 6 and 7 can produce different jet configurations. For example, by varying factors such as the number of passages, the passage cross-section, the inclination angle and the passage distance from the seat central axis, various jet configurations that can produce different "fan" shapes, rotations and swirls in the jet flow can also be created.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

In the claims:

1. A fuel injector having a fuel inlet, a fuel outlet, and a fuel passageway extending from the fuel inlet to the fuel outlet along a longitudinal central axis, the fuel injector comprising:

a body;

a needle slidingly disposed within the body between a first position and a second position; and a seat disposed at the fuel outlet, the seat including:

a seat surface contiguous to a portion of the needle in the first position to form a seal between the fuel passageway and the fuel outlet, the seat surface being spaced from the portion of the needle in a second position of the needle to permit fuel flow through the fuel outlet, the seat surface being oblique to the longitudinal central axis, and a plurality of passages, each of the plurality of passages having a passage surface extending along a central axis that defines an angle of inclination relative to the longitudinal central axis, a portion of the passage surface aligned on the same line with and contiguous to the surface of the seat on a common plane such that each central axis intersects the longitudinal central axis and each other at a common point on the longitudinal central axis.

2. The fuel injector according to claim 1, wherein at least one of the plurality of passages is at a different distance from the longitudinal central axis than the other passages.

3. The fuel injector according to claim 1, wherein at least one of the plurality of passages is at a same distance from the longitudinal central axis as the other passages.

4. The fuel injector according to claim 1, wherein at least one of the plurality of passages has a same cross-section as the other passages.

5. The fuel injector according to claim 1, wherein at least one of the plurality of passages has a different cross-section than the other passages.

6. The fuel injector according to claim 1, wherein the angle of inclination for at least one of the plurality of passages is the same as the other passages.

7. The fuel injector according to claim 1, wherein the angle of inclination for at least one of the plurality of passages is different than the other passages.

8. A spray pattern of fuel generated by a fuel injector comprising:

a fuel injector including:

a fuel inlet, a fuel outlet, a fuel passageway extending from the fuel inlet to the fuel outlet along a longitudinal central axis, a body, a needle slidingly disposed within the body between a first position and a second position, a seat surface contiguous to a portion of the needle in the first position to form a seal between the fuel passageway and the fuel outlet, the seat surface being spaced from the portion of the needle in a second position of the needle to permit fuel flow through the fuel outlet that generates a spray pattern, the seat surface being oblique to the longitudinal central axis, a plurality of passages, each of the plurality of passages having a passage surface extending along a central axis that defines an angle of inclination relative to the longitudinal central axis, a portion of the passage surface aligned on the same line with and contiguous to the surface of the seat on a common plane such that each central axis intersects the longitudinal central axis and each other at a common point on the longitudinal central axis; and the spray pattern including:

at least two portions of fuel, the fuel being combustible in a combustion chamber of an internal combustion engine, wherein a first portion includes a fan shape spray of fuel and the second portion includes at least one plume of fuel adjacent the fan shape spray.

9. The spray pattern according to claim 8, wherein the fan shape corresponds to the number of inclined passages.

10. The spray pattern according to claim 8, wherein the fan shape corresponds to a cross-section of each of the plurality of inclined passages.

11. The spray pattern according to claim 8, wherein the fan shape corresponds to the angle of inclination of each of the plurality of inclined passages.

12. The spray pattern according to claim 8, wherein the fan shape corresponds to a distance of each of the plurality of inclined passages from the longitudinal central axis.

13. A method of generating a spray pattern from a fuel injector in a direct injection application, the fuel injector having a fuel inlet, a fuel outlet, a fuel passageway extending from the fuel inlet to the fuel outlet along a longitudinal central axis, the fuel injector comprising:

a body;

a needle slidingly disposed within the body between a first position and a second position; and a seat disposed at the fuel outlet, the seat including:

a seat surface contiguous to a portion of the needle in the first position to form a seal between the fuel passageway and the fuel outlet, the seat surface being spaced from the portion of the needle in a second position of the needle to permit fuel flow through the fuel outlet, the seat surface being oblique to the longitudinal central axis; and a plurality of passages, each of the plurality of passages having a passage surface extending along a central axis that defines an angle of inclination relative to the longitudinal central axis, a portion of the passage surface aligned on the same line with and contiguous to the surface of the seat on a common plane such that each central axis intersects the longitudinal central axis and each other at a common point on the longitudinal central axis;

the method comprising the steps of:

providing the fuel injector; and supplying fuel to the fuel injector so that a spray pattern is formed.

14. The method according to claim 13, wherein the spray pattern has a fan shape, the fan shape corresponds to the number of inclined passages.

15. The method according to claim 13, wherein the spray pattern has a fan shape, the fan shape corresponds to a cross-section of each of the plurality of inclined passages.

16. The method according to claim 13, wherein the spray pattern has a fan shape, the fan shape corresponds to the angle of inclination of each of the plurality of inclined passages.

17. The method according to claim 13, wherein the spray pattern has a fan shape, the fan shape corresponds to a distance of each of the plurality of inclined passages from the longitudinal axis.

18. The method according to claim 13, the spray pattern has a fan shape, the fan shaped spray pattern has a plurality of plumes.

19. The method according to claim 13, wherein at least one of the plurality of passages is at a different distance from the longitudinal central axis than the other passages.

20. The method according to claim 13, wherein at least one of the plurality of passages is at a same distance from the longitudinal central axis as the other passages.

21. The method according to claim 13, wherein at least one of the plurality of passages has a same cross-section as the other passages.

22. The method according to claim 13, wherein at least one of the plurality of passages has a different cross-section than the other passages.

23. The method according to claim 13, wherein the angle of inclination for at least one of the plurality of passages is the same as the other passages.

24. The method according to claim 13, wherein the angle of inclination for at least one of the plurality of passages is different than the other passages.

* * * * *